United States Patent [19]

Hobart

[11] 3,948,150

[45] Apr. 6, 1976

[54] TUBE FORMER

[76] Inventor: Jack Hobart, 24 Riversleigh Road, Leamington Spa, England

[22] Filed: Jan. 21, 1975

[21] Appl. No.: 542,813

[30] Foreign Application Priority Data

Jan. 24, 1974 United Kingdom ..... 3303/74

[52] U.S. Cl. ..... 93/20; 53/180 M; 93/82; 156/466

[51] Int. Cl.[2] ..... B31B 23/26; B31B 23/60

[58] Field of Search ..... 53/180, 182, 177, 191, 53/192, 183; 93/14, 17, 18, 19, 20, 82, 84 TW; 156/203, 466

[56] References Cited

UNITED STATES PATENTS

| | | | |
|---|---|---|---|
| 3,122,072 | 2/1964 | Monsees et al. | 93/82 |
| 3,370,517 | 2/1968 | Vichos | 93/82 |
| 3,636,826 | 1/1972 | Bowen et al. | 53/180 X |
| 3,785,112 | 1/1974 | Leasure et al. | 53/180 X |

*Primary Examiner*—Travis S. McGehee
*Assistant Examiner*—Horace M. Culver
*Attorney, Agent, or Firm*—Edward F. Connors

[57] ABSTRACT

A tube former, including a body defining a preformer surface over which an elongate sheet of packaging material is to be pulled towards an edge of the preformer surface which defines an aperture through which the sheet is to be drawn at an acute angle to the preformer surface, the relative shape and positioning of the aperture and the preformer surface being such that the resulting tube will have its longitudinal edges slightly overlapped, and the body being so shaped adjacent the aperture that the wall of the tube may locally be distorted outwardly without engaging the body.

5 Claims, 3 Drawing Figures

TUBE FORMER

The invention relates to a former for manipulating an elongate sheet of packaging material into a tube.

Such formers are commonly used in packaging machines of the form and fill type and usually comprise a preformer portion that is secured at an acute angle to an upright tubular support body, having an internal diameter corresponding closely with the external diameter of the tube which is to be formed. The sheet is drawn over the curved surface of the preformer section and is then reversely directed through the tubular support body thereby manipulating the sheet into a tube having its longitudinal edges slightly overlapped. After passing through the tubular support body, these overlapped edges pass a stationary sealing head which causes them to adhere to each other. A transition line is defined by the intersection between the tubular support body and the preformer portion, and the transition line and the surface of the preformer portion are carefully designed so that the sheet is smoothly manipulated into a tube without tearing or crinkling. After the overlapped edges of the tube have been adhered together, the tube passes a transverse sealing and cutting head which is arranged to flatten the tube transversely, seal the opposite sides together, and then separate the tube transversely through the middle of the transverse seal. In this manner, the top of one bag and the bottom of an adjacent bag are formed simultaneously. Each bag is charged with product by discharging a predetermined quantity of the product into the top of the tubular support body so that the product will fall into the partly formed bag to be supported by the last made bottom seal. The product is then packed downwards by a stripping device before the next transverse seal is made to complete and separate the packed bag.

The operation of form and fill packaging machines utilising this known type of former will be interrupted if the product being discharged into the tubular support body bridges the opening to such an extent as to interfere with the proper feeding of the product into the bottom of the bag that is being formed. Although such a blockage will tend to move downwards due to the engagement of the product with the walls of the intermittently moving tube, it will disturb the operating cycle of the machine resulting in a series of unfilled or partly filled bags. As the transverse sealing and cutting head is essentially positioned after the end of the tubular support body, it is essential for each charge of product to move freely downwardly relatively to the wall of the tube. This type of feed blockage is most likely to occur when packing light irregular products such as potato crisps.

An object of this invention is to provide a former which can manipulate an elongate sheet of packaging material into a tube that can be filled with light, irregular products with less risk of a feed blockage.

According to the invention a former, for manipulating an elongate sheet of packaging material into a tube, includes a body defining a preformer surface over which the sheet is to be pulled towards an edge of the preformer surface, said edge defining an aperture through which the sheet is to be drawn in a predetermined direction that is at an acute angle to the preformer surface, the aperture and the preformer surface being so shaped and positioned relative to each other that the portion of the sheet passing through the aperture will be manipulated into a tube having its longitudinal edges slightly overlapped, and the body being so shaped adjacent the aperture that the wall of the tube of packaging material may locally be distorted outwardly without engaging the body. In this manner, an irregular product feed through the aperture is less likely to bridge across the tube and cause a feed blockage as the wall of the tube will be free to distort outwardly thereby allowing the product to move relative to the tube.

The body of the former preferably defines mounting means positioned remote from the aperture, said mounting means enabling the body to be secured to a packaging machine. In this manner the former can be supported from the packaging machine without using the previously proposed tubular support body. The body of the former may be made of sheet material, in which case the body may define a flange which is turned away from the preformer surface to provide said mounting. Alternatively, the body may be formed as a casting.

The invention also includes a former and packaging machine combination, said former including a body defining a preformer surface over which the sheet is to be pulled towards an edge of the preformer surface, said edge defining an aperture through which the sheet is to be drawn in a predetermined direction that is at an acute angle to the preformer surface, the aperture and the preformer surface being so shaped and positioned relative to each other that the portion of the sheet passing through the aperture will be manipulated into a tube having its longitudinal edges slightly overlapped, and the body being so shaped adjacent the aperture that the wall of the tube of packaging material may locally be distorted outwardly without engaging the body, said body defining mounting means positioned remote from the aperture, said mounting means securing the body to the packaging machine to enable the preformed tube to receive product to be delivered by said packaging machine.

The invention will now be described, by way of example only, with reference to the accompanying drawings, in which.

Figure 1:
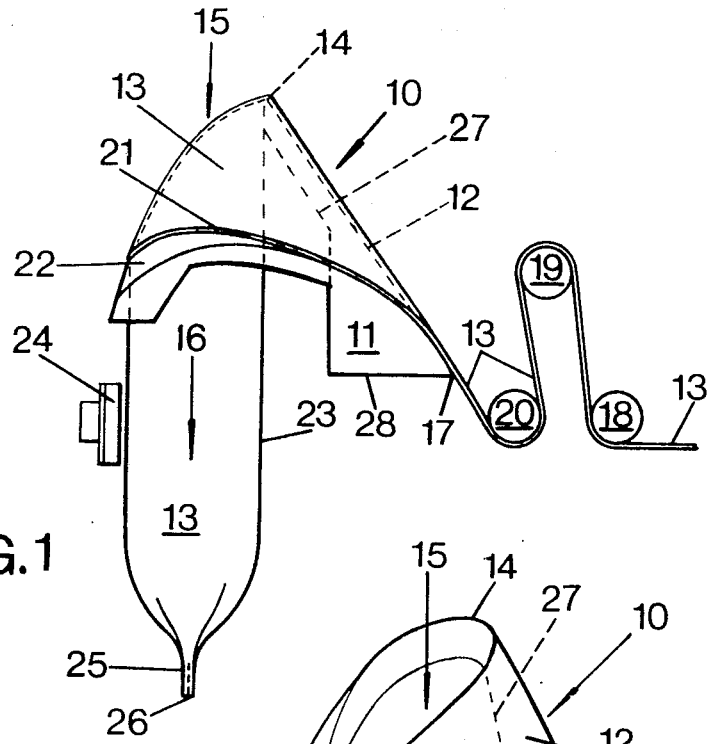
FIG. 1 is a diagrammatic side elevation showing one kind of former being used for manipulating an elongate sheet of packaging material into a tube.

In the drawings, the former is indicated generally by arrow 10 and comprises a body 11, which defines a preformer surface 12 for supporting one side of a sheet 13 of pre-printed transparent packaging film. The top edge 14 of the preformer surface defines an aperture 15 through which the sheet 13 is to be drawn in the direction of arrow 16. The preformer surface 12 is shaped so that it curves progressively from its straight bottom edge 17 towards the top edge 14 as shown.

The sheet of packaging film 13 is of constant width and is conveniently stored on an unshown roll from which it is led through various rollers 18, 19 and 20 which serve generally to straighten the sheet and to apply a predetermined tension to it. The roller 20 is positioned so that the sheet 13 is led smoothly over the bottom edge 17 of the preformer surface 12. As the sheet 13 moves upwardly over the preformer surface 12, its longitudinal edges (of which one is shown at 21) are progressively curved first downwardly relative to the middle of the sheet, and are then moved towards each other due to their engagement with two wing areas 22 of the preformer surface 12. On reaching the top edge 14, the sheet 13 is subjected to an abrupt change of direction and is effectively turned inside out. It will be noted that the new direction 16, in which the sheet 13 is constrained to pass through the aperture 15, is at an acute angle to the plane of the preformer surface 12. The profile of the top edge 14 and the curvature of the preformer surface 12 are shaped and positioned relative to each other, in a manner well known in the art, so that the portion of the sheet passing through the aperture 15 will be manipulated as shown into a tube 23. The longitudinal edge 21 slightly overlaps the opposite longitudinal edge of the formed sheet, and these overlappped edges pass a stationary sealing head 24 which causes them to adhere to each other in a manner also well known in the art. After the overlapped edges of the tube 23 have been adhered together, the tube passes an unshown transverse sealing and cutting head which can be arranged in known manner to flatten the tube 23 transversely and seal the opposite sides together as indicated at 25, whilst simultaneously severing the tube at 26 through the middle of the transverse seal to separate the completed bag below th cut 26. The partially completed bag 23 shown in FIG. 1 is now charged with product, such as potato crisps, by discharging a predetermined weight of the product into the aperture 15. The body 11 is relieved at 27 to prevent any of the product from causing a feed blockage by bridging across the partially completed bag 23 within the aperture 15. In this manner, any product tending to bridge across the partially completed bag 23 merely causes the tube to be distorted outwardly in that locality and, due to the inherently flimsy nature of the packaging film, the product then slides smoothly downwards towards the bottom seal 25. In contradistinction, previously proposed formers have a tubular support body closely surrounding the tube 23 thereby preventing any significant outward distortion of the tube 23. After the partially completed bag 23 has been charged with product, the product can then be packed downwards in known manner by a stripping device before the bag is sealed and separated from the newly generated partially completed bag.

Figure 2:
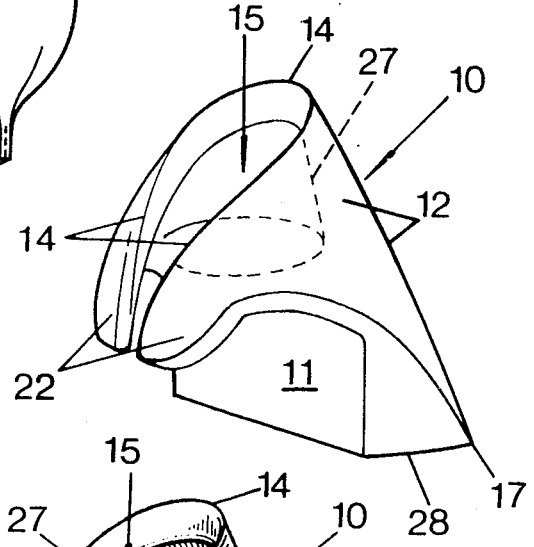
FIG. 2 is a perspective view of the former shown in FIG. 1.

The body 11 of the former shown in FIGS. 1 and 2 is made as a light alloy casting of the shape shown, the preformer surface 12, including the wings 22 and the edge 14 being carefully machined and finished to provide a smooth surface for supporting the sheet of packaging film. Adjacent the bottom edge 17 of the preformer surface 12, the casting is enlarged to provide a mounting flange 28 by which it is to be secured to the packaging machine. By arranging this mounting flange remote from the aperture 15 and outside the relieved area 27, the mounting of the former does not restrict the sides of the partly formed tube 23 as has been the case with previously proposed formers having a tubular support body closely surrounding the tube 23.

Figure 3:
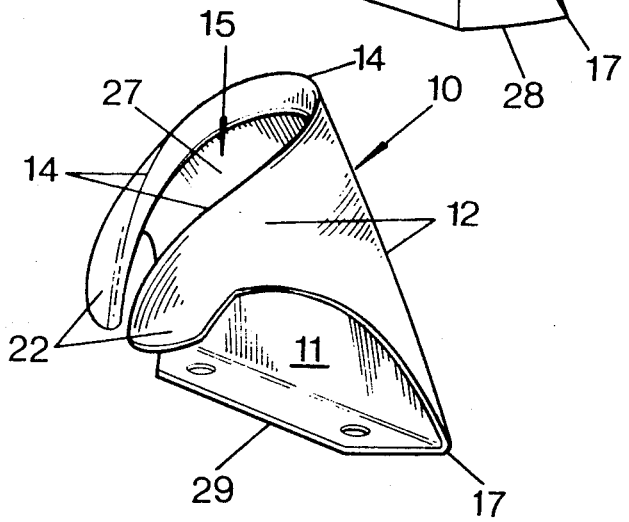
FIG. 3 is a corresponding perspective view of another former.

FIG. 3 shows an alternative construction, the body 11 of the former being fabricated from sheet metal such as stainless steel. The shapes of the aperture 15 and the preformer surface 12 including the wings 22 is the same as those of the previous embodiment, but the use of sheet material increases the maximum relief 27 that is available. Conveniently, the sheet defining the preformer surface 12 is turned away from the preformer surface to provide a mounting flange 29.

What I claim as my invention and desire to secure by Letters Patent of the United States is:

1. A former, for manipulating an elongate sheet of packaging material into a tube, comprising a body, a preformer surface defined by said body and over which the sheet is to be pulled towards an edge of the preformer surface, said edge defining an aperture through which the sheet is to be drawn in a predetermined path that is at an acute angle to the preformer surface, the aperture and the preformer surface being so shaped and positioned relative to each other that the portion of the sheet passing through the aperture will be manipulated into a tube having its longitudinal edges slightly overlapped, the body defining an internal surface adjacent the aperture, said internal surface being at an acute angle to said path and to said preformer surface, and the dimensions of sad aperture and said internal surface being such that a clearance will be defined between the entire said internal surface and the wall of the tube of packaging material whereby the wall of the tube of packaging material may locally be distorted outwardly in any direction without engaging said internal surface of the body.

2. A former, as in claim 1, in which mounting means is defined by said body and is positioned remote from the aperture to enable the body to be secured to a packaging machine.

3. A former, as in claim 1, in which the body is formed from sheet material.

4. A former, as in claim 3, in which mounting means is defined by said body and is positioned remote from said aperture to enable the body to be secured to a packaging machine, a flange being defined by said body and being turned away from the preformer surface to provide said mounting means.

5. A former, as in claim 1, in which the body is formed as a casting.

* * * * *